US010315794B2

(12) United States Patent
Yoshikane et al.

(10) Patent No.: US 10,315,794 B2
(45) Date of Patent: Jun. 11, 2019

(54) BAG MOUTH OPENING DEVICE FOR CONTINUOUSLY CONVEYED BAGS

(71) Applicant: Toyo Jidoki Co., Ltd., Minato-ku, Tokyo (JP)

(72) Inventors: Tohru Yoshikane, Iwakuni (JP); Masafumi Ueno, Wakayama (JP)

(73) Assignee: Toyo Jidoki Co., Ltd., Minato-ku (JP)

( * ) Notice: Subject to any disclaimer, the term of this patent is extended or adjusted under 35 U.S.C. 154(b) by 845 days.

(21) Appl. No.: 14/296,171

(22) Filed: Jun. 4, 2014

(65) Prior Publication Data

US 2014/0360133 A1 Dec. 11, 2014

(30) Foreign Application Priority Data

Jun. 5, 2013 (JP) ..... 2013-118835

(51) Int. Cl.

| | |
|---|---|
| ***B65B 43/18*** | (2006.01) |
| ***B65B 43/30*** | (2006.01) |
| *B31B 70/00* | (2017.01) |

(52) U.S. Cl.

CPC ..... *B65B 43/30* (2013.01); *B31B 70/003* (2017.08)

(58) Field of Classification Search

CPC ..... B65B 43/18; B65B 43/30; B65B 43/465

USPC ..... 53/381.1, 384.1, 386.1, 459, 570

See application file for complete search history.

(56) References Cited

U.S. PATENT DOCUMENTS

| | | | | |
|---|---|---|---|---|
| 3,501,893 | A * | 3/1970 | Peterson | B65B 43/18 53/386.1 |
| 3,577,704 | A * | 5/1971 | Lense | B65B 43/30 53/386.1 |
| 4,945,714 | A * | 8/1990 | Bodolay | B65B 9/093 493/194 |
| 5,140,801 | A * | 8/1992 | Wild | B65B 43/30 141/157 |
| 5,179,816 | A | 1/1993 | Wojnicki | |
| 6,240,707 | B1 * | 6/2001 | Ford | B65B 43/305 493/315 |
| 6,655,111 | B2 * | 12/2003 | Ikemoto | B65B 43/30 53/386.1 |
| 2008/0090690 | A1 * | 4/2008 | Lee | F16H 3/76 475/207 |

FOREIGN PATENT DOCUMENTS

| | | |
|---|---|---|
| DE | 1047600 | 12/1958 |
| DE | 1050168 | 2/1959 |
| EP | 1234770 A1 | 8/2002 |

(Continued)

*Primary Examiner* — Andrew M Tecco
*Assistant Examiner* — Eyamindae C Jallow
(74) *Attorney, Agent, or Firm* — Norton Rose Fulbright US LLP

(57) ABSTRACT

A bag mouth opening device for continuously conveyed bags including suction cups (16, 17) continuously rotated in mutually opposite directions along substantially symmetrical elliptical moving paths (24, 25) on ether side of a conveying path (1) for bags. The time the suction cups take to make their single rotation along the moving paths matches the time a bag (20) takes to be conveyed for an inter-bag distance(s). The major axes (26, 27) of both moving paths of the suction cups are inclined at almost the same angles relative to the conveying path and digress from the bag conveying path toward their anterior side.

7 Claims, 11 Drawing Sheets

(56) References Cited

FOREIGN PATENT DOCUMENTS

| | | | |
|---|---|---|---|
| JP | S50-31977 | A | 3/1975 |
| JP | 2001-072004 | A | 3/2001 |
| JP | 2002-255119 | A | 9/2002 |
| JP | 2002-302227 | A | 10/2002 |
| JP | 2002-308223 | A | 10/2002 |
| JP | 2004-238040 | A | 8/2004 |
| JP | 2009-161230 | A | 7/2009 |

* cited by examiner

BAG MOUTH OPENING DEVICE FOR CONTINUOUSLY CONVEYED BAGS

BACKGROUND OF THE INVENTION

1. Field of the Invention

The present invention relates to a bag mouth opening device and more particularly to a device that adheres suction members facing each other on either side of a bag conveying path to both sides of the mouths of bags continuously conveyed along the bag conveying path at a constant speed and then moves the suction members away from each other to open the mouths of the bags.

2. Description of the Related Art

FIG. 11 shows the bag mouth opening device described in Japanese Patent Application Laid-Open (Kokai) No. 2002-255119. In this the bag mouth opening device, a pair of suction cups 2, 3 provided so as to face each other on either side of a conveying path (bag conveying path) 1 along which the bags (not shown) are conveyed are continuously rotated along the circular moving paths 4, 5 in mutually opposite directions (see arrows in the circular moving paths 4, 5) at a speed equal to the conveying speed of the bags (see the leftward arrow on the conveying path 1 indicative of the bag conveying direction). The time the suction cups 2, 3 take to make a single rotation along the circular moving paths 4, 5 is adjusted to match the time a bag to be conveyed takes for an inter-bag distance (1 (one) pitch (which is the distance between two bags being conveyed)) along the bag conveying path or the time that is an integer multiple thereof. When the cups 2,3 continuously rotate along the circular moving paths 4, 5, they keep their suction surfaces to be oriented frontally (in other words, toward the bag conveying path 1) at all times while maintaining mutually symmetrical positions on either side of the bag conveying path 1.

In comparison with bag mouth opening devices existing previously, the bag mouth opening device of Japanese Patent Application Laid-Open (Kokai) No. 2002-255119 has such advantages that it is able to offer a simpler and more compact construction, to provide a reduction in vibration and noise, and to increase the speed of operation.

In the bag mouth opening device described in Japanese Patent Application Laid-Open (Kokai) No. 2002-255119, the suction cups 2, 3 are continuously rotated along the circular moving paths 4, 5 in mutually opposite directions at a speed equal to the speed of the bag conveyed (which is a constant speed); and when the cups are closest to each other in the circular moving paths 4, 5, they adhere with suction to both sides of a bag conveyed along the bag conveying path 1. After adhering to the bag, the suction cups 2, 3 travel in the bag conveying direction (toward the left side of FIG. 11) while moving away from each other (away from the bag conveying path 1) as the bag is conveyed.

The suction cups 2, 3 travel along the circular moving paths 4, 5 at a constant speed, and in position $P_0$, where the suction cups 2, 3 come close together again, the direction of travel of the suction cups 2, 3 coincides with the bag conveying direction. Accordingly, in position $P_0$, the speed of travel of the suction cups 2, 3 in the bag conveying direction is equal to the speed of bag conveyed. However, since the suction cups 2, 3 travel along the circular moving paths 4, 5, the speed of travel of the suction cups 2, 3 in the bag conveying direction thereafter becomes subsequently smaller (when compared with the speed of the bag conveyed).

It should be noted that if the speed of bag conveyed (the speed of travel of the suction cups 2, 3 along the circular moving paths 4, 5) is designated as $V_0$, then the traveling speed V of the suction cups 2, 3 in the bag conveying direction after the suction cups 2, 3 have traveled through an angle of θ from the position $P_0$ where the two cups approach toward each other the most along the circular moving paths is shown by $V=V_0 \cos \theta$.

Although the bag conveying speed $V_0$ is constant, the traveling speed V of the suction cups 2, 3 in the bag conveying direction decreases during the rotation along the circular moving paths 4, 5. After the suction cups 2, 3 adhere to the bag in position $P_0$ ($\theta=0°$), the difference ($V_0$ minus (−) V) between the bag conveying speed $V_0$ and the traveling speed V of the suction cups 2, 3 in the bag conveying direction increases over time, resulting in that the suction cups 2, 3 start lagging behind the bag.

Japanese Patent Application Laid-Open (Kokai) No. 2002-255119 describes in paragraph 13 that the flexibility of the bag absorbs the difference ($V_0$ minus (−) V) between the bag conveying speed $V_0$ and the traveling speed V of the suction cups 2, 3 in the bag conveying direction, so that this speed difference does not lead to any particular problems. However, this description in Japanese Patent Application Laid-Open (Kokai) No. 2002-255119 is based on the premise that bags processed are relatively small in width dimensions. When bags are relatively small in width dimensions, the spacing distance D (see FIG. 11) between the suction cups 2, 3 that have reached the position to fully open the mouth of the bag is small, and as a result the traveling angle θ of the cups from the position $P_0$ along the circular moving paths 4, 5 can be small. For this reason, the speed difference between the bag and the cups does not increase very much, and this speed difference can be absorbed by the flexibility of the bag.

When the bag processed is relatively large in width dimensions, it is necessary to increase the spacing distance D between the suction cups 2, 3 to reach the position to fully open the mouth of the bag. Assuming that the radius of the circular moving paths 4, 5 does not change, then it is necessary to increase the traveling angle θ of the suction cups 2, 3 to fully open the mouth of the bag. If the traveling angle θ of the suction cups 2, 3 increases, the traveling speed V of the suction cups 2, 3 in the bag conveying direction becomes smaller, and the speed difference ($V_0$−V) between the bag conveying speed $V_0$ of the bag and the traveling speed V of the suction cups 2, 3 in the bag conveying direction becomes larger. For this reason, positional misalignment between the bag and the suction cups 2, 3 in the bag conveying direction increases as much as it becomes difficult to absorb the misalignment even if the advantage of the flexibility of the bag is taken into account, resulting in that the suction cups 2, 3 become detached from the bag while the mouth is opened, causing mouth opening failures. In addition, even in a case that the suction cups 2, 3 do not become detached from the bag, since forces in a direction opposite to the conveying direction act on the bag while the mouth is being opened, various problems would arise, including that the bag is detached from the grippers, the bag is displaced from the regular holding position, and the shape of the opened bag mouth is distorted.

If the radius of the circular moving paths 4, 5 in the above-described bag mouth opening device can be increased, even if the traveling angle θ of the suction cups 2, 3 reached the position where the mouth of the bag is fully opened is small, the spacing distance D between the suction cups 2, 3 can be increased, and the speed difference between the bag conveying speed $V_0$ and the traveling speed V of the suction cups 2, 3 in the bag conveying direction does not become excessively large even when the mouth of bag that is relatively large in width dimensions is opened, and this speed difference can be absorbed by taking (advantage of) the flexibility of the bag into account. However, in the above-described bag mouth opening device, the speed of rotation of the suction cups 2, 3 along the circular moving paths 4, 5 is adjusted to match the conveying speed of bag, and the time period the suction cups 2, 3 take to make a single rotation along the circular moving paths 4, 5 is adjusted to match the time the bag is conveyed for an inter-bag distance (1 pitch), or it is set to an integer multiple thereof. For this reason, the radius of the circular moving paths 4, 5 is inevitably set to a constant value. In other words, in the above-described bag mouth opening device, it is substantially difficult to vary the radius of the circular moving paths 4, 5 in accordance with the width dimensions of the bags to be processed.

BRIEF SUMMARY OF THE INVENTION

The present invention is devised by taking into account the problems with the bag mouth opening device described in Japanese Patent Application Laid-Open (Kokai) No. 2002-255119, and it is an object of the invention to provide a bag mouth opening device that is capable of opening the mouths of bags in a more reliable and stable manner regardless of the size of the width direction of bags.

The above object is accomplished by a unique structure of the present invention for a bag mouth opening device for bags continuously conveyed in which a pair of opposed suction members (suction cups) are adhered to both sides of the mouth of each bag continuously conveyed along a bag conveying path at a constant speed and regular intervals, and then the suction members are moved away from each other to thereby open the mouth of the bag, and in the present invention,

- the pair of suction members are continuously rotated in mutually opposite directions along their moving paths of a substantially elliptical shape while keeping their suction surfaces oriented frontally (or toward the bag conveying path) in a plane substantially parallel to the conveying path and substantially perpendicular to the surface of the bag, and
- the moving paths of the suction members have their major axes inclined at substantially equal angles with respect to the bag conveying path such that they digress from the conveying path toward the anterior side, and the time the suction members take to make their single rotation along the moving paths is set to be an integer (including 1) multiple of the time a bag to be conveyed takes for an inter-bag distance (which is the distance between two bags being conveyed).

Needless to say, the direction of rotation of the suction members cannot be opposite to the bag conveying direction.

In the above structure and as used herein, the term "substantially elliptical" includes the shape of an ellipse as defined in geometry, as well as shapes close to an ellipse, for example, a racetrack shape (a shape in which two semi-circles are connected by two straight lines), an oval, or a shape obtained by compressing an ellipse in the direction of its major or minor axes.

In the above-described structure, the pairs of (or two) suction members are provided on, for instance, a pair of (two) rotation transmission members, respectively, that make a translational motion along the moving paths of substantially elliptical shape. The rotation transmission members that make the translational motion are oriented in the same direction at all times, and the motion of the pairs of suction members provided on the rotation transmission members respectively is thus a translational motion as well, and further the suction surfaces of the suction members are oriented in the same direction (frontally) at all times during the rotation along the moving paths so that the suction surfaces always face the bag conveying path.

The mechanism that causes each one of the rotation transmission members to make the translational motion is comprised of, for example,

- two first rotating shafts connected to a common drive source and rotated in the same direction at a constant speed;
- a first rotating lever secured to each one of the first rotating shafts;
- a second rotating shaft which is journaled on each one of first rotating levers in a rotatable manner in locations offset equidistantly and in the same direction relative to the first rotating shafts and turns at a constant speed in a direction opposite to the direction of rotation of the first rotating shafts;
- a second rotating lever secured to each one of the second rotating shafts; and
- a support shaft provided on each one of the second rotating levers in locations offset equidistantly and in the same direction relative to the second rotating shafts, and the rotation transmission members are coupled to the support shafts so as to make the translational motion.

Furthermore, the drive mechanism that causes each one of the second rotating shafts to turn in the same direction at a constant speed is comprised of:

- a fixed sun gear whose center is on the axial line of the first rotating shaft;
- a planetary gear rotatably journaled on the first rotating lever and meshing with the sun gear; and
- a driven gear secured to the second rotating shaft and meshing with the planetary gear.

In this structure of the drive mechanism that causes each one of the second rotating shafts to turn in the same direction at a constant speed, the gear ratio of the sun gear and the driven gear is set to 2:1. On the other hand, instead of such a planetary gear mechanism, it is possible to employ other drive sources such as, for instance, servo motors so that the drive source is provided on the first rotating lever to turn the second rotating shaft.

Similarly to the bag mouth opening device of Japanese Patent Application Laid-Open (Kokai) No. 2002-255119, if necessary, a plurality of sets of suction members can be installed at intervals equal to the inter-bag distance in the bag conveying direction. If only one pair (or one set) of suction members is installed along the bag conveying path as will be described below, the time the suction members take to make their single rotations is set to be equal to the time a bag is conveyed for an inter-bag distance. However, when a plurality of sets of suction members are provided, then the time those suction members take to make their single rotations is set to a time obtained by multiplying the number of sets by the time a bag is conveyed for an inter-bag distance. In addition, when a plurality of pairs or sets of suction members are provided, the circumferential lengths of the suction member moving paths of substantially elliptical shape can be increased by the same scaling factor.

The bag mouth opening device of the present invention is applicable mostly to cases in which the mouth of a bag is upwardly oriented and the bag is conveyed horizontally in the bag width direction in a vertical state with both side or lateral edges of the bag being held by grippers so that the bag is suspended or held with retainers, etc. The device of the present invention is, nonetheless, further applicable to cases in which bags are conveyed in the longitudinal (depth) direction or in which bags are oriented horizontally and conveyed in the width or longitudinal direction. In other words, bag mouth opening device of the present invention is applicable broadly to cases in which bags are conveyed in the width or longitudinal direction along the bag surface. In addition, the bag mouth opening device of the present invention is applicable not only to cases in which bags are conveyed substantially linearly, but also to case, for instance, in which the bags are held by numerous grippers installed around a rotating table and conveyed along a circular moving path of a relatively large diameter. In such a case, the moving paths of the suction members that are substantially elliptical shape can be defined by considering, for instance, the direction, which is tangential to the bag conveying path at a point (point of adhesion) where the moving paths of substantially elliptical shape reach the conveying path, as a bag conveying direction.

As seen from the above, in the bag mouth opening device of the present invention, the shape of the moving paths along which the pair of suction members rotate is substantially elliptical and not circular as seen in the prior art, and their major axes are tilted so that they digress from (or separate from) the bag conveying path toward the anterior side (which is a forward side in terms of the bag conveying direction), thereby making it possible to better prevent, in comparison with circular suction member moving paths, an increase in the difference between the conveying speed of the bag and the traveling speed of the suction members in the bag conveying direction in the process of mouth opening that occurs subsequent to adhesion of the pair of suction members to a bag. For this reason, when bags of relatively large in width dimensions are to be opened, the opening action for the mouths of such bags can be made in a more reliable and stable manner in comparison with the bag mouth opening device of Japanese Patent Application Laid-Open (Kokai) No. 2002-255119. In addition, in the same manner as in the bag mouth opening device of Japanese Patent Application Laid-Open (Kokai) No. 2002-255119, the bag mouth opening device of the present invention is able to provide a simpler and more compact construction, a reduction in vibration and noise, and an increase in the speed of operation.

DETAILED DESCRIPTION OF THE INVENTION

The bag mouth opening device according to the present invention is described below with reference to FIG. 1 through FIG. 10.

Figure 1:
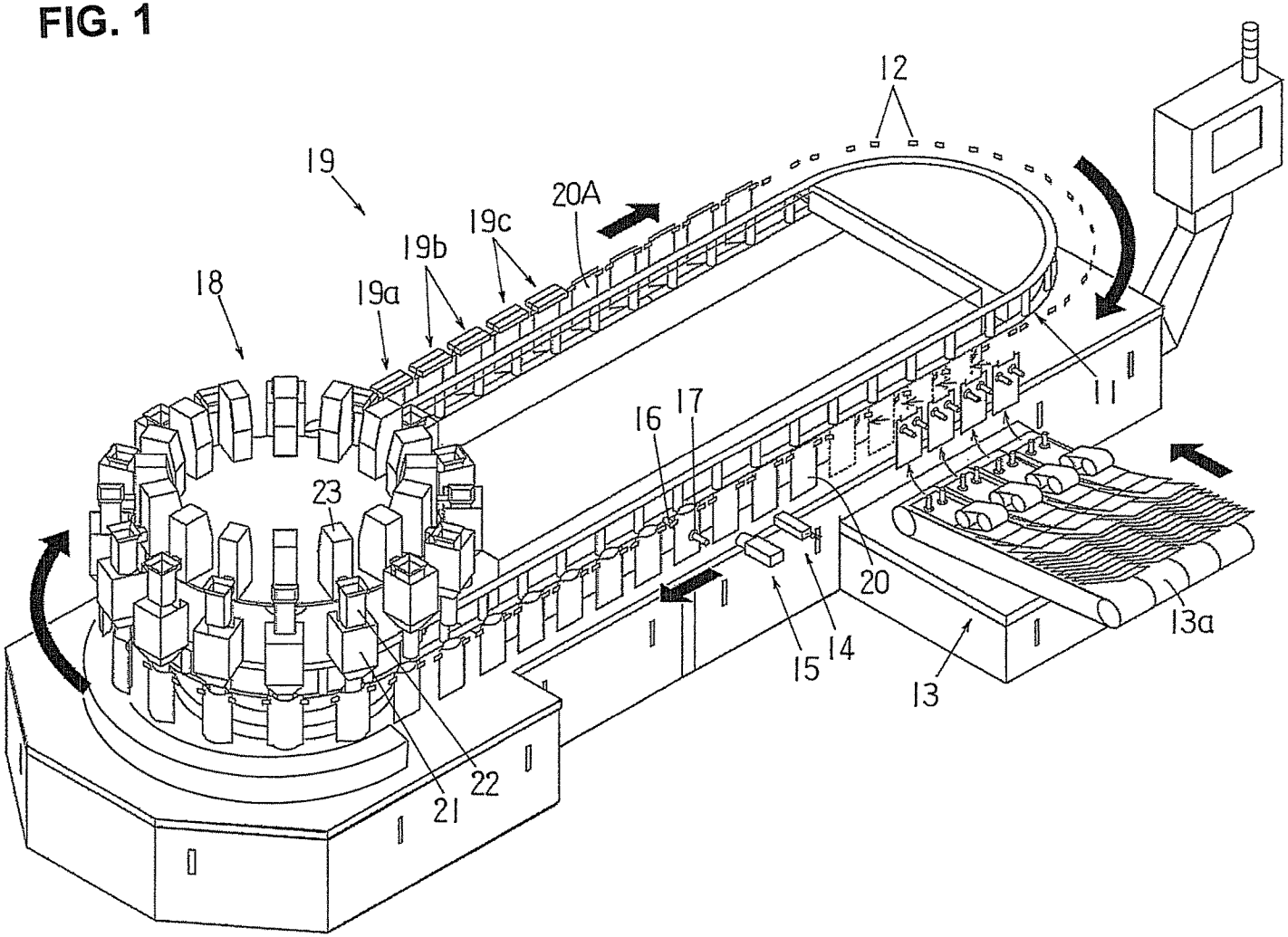
FIG. 1 is a perspective view of one example of a continuous transportation type bag filling and packaging apparatus that uses the bag mouth opening device of the present invention.

A continuous transportation type bag filling and packaging apparatus that uses the bag mouth opening device of the present invention is illustrated in FIG. 1.

The continuous transportation type bag filling and packaging apparatus of FIG. 1 includes an endless chain 11 which travels along a racetrack-shaped annular path comprised of arcuate sections at both ends and rectilinear sections between the arcuate end sections, and it also includes multiple sets of grippers 12 (two of or a pair of grippers constitutes one set of grippers), which are installed at equal intervals in the lengthwise direction of the endless chain 11 and travel along a similarly racetrack-shaped annular moving path together with the endless chain 11. A bag feeding device 13, a printer 14, a print testing device 15, a bag mouth opening device (only the suction cups 16, 17 are illustrated), a filling device 18, a sealing device 19, an empty bag discharging device (not illustrated), a product bag discharging device (not illustrated), and the like are disposed along the annular moving path for the grippers 12.

As the grippers 12 rotationally travel along the annular moving path, various operations are carried out to bags: feeding bags 20 to the grippers 12 using the bag feeding device 13, holding both side or lateral edges of each one of the bags using the grippers 12, printing, for instance, a manufacturing date on the surface of the bag using the printer 14, print testing using the print testing device 15, opening the mouth of the bag using the bag mouth opening device (only suction cups 16, 17 are illustrated), filling the bag with the material to be packaged using the filling device 18, sealing the mouth of the bag (including cooling) using the sealing device 19, discharging a product bag 20A (a bag filled with the material to be packaged) using the product bag discharging device, and the like.

The endless chain 11 and the grippers 12, as well as the mechanism that moves the endless chain 11, are identical to those employed in the devices described in Japanese Patent Application Laid-Open (Kokai) Nos. 2002-302227 and 2009-161230. More specifically, the endless chain 11 is a chain formed by numerous links connected via connecting shafts in endless form such that one set (one pair) of grippers 12 is provided on the outside of each link. The grippers 12 are installed at regular intervals along the endless chain 11, and, as the endless chain 11 moves, the grippers continuously rotate at a constant speed in a horizontal plane along the racetrack-shaped annular moving path (clockwise as viewed from above in FIG. 1, see two curved and straight arrows). The bags 20 held by the grippers 12 are continuously conveyed at a constant speed and regular intervals in a horizontal plane along the racetrack-shaped conveying path.

The bag feeding device 13 is identical to the empty bag feeding device described in Japanese Patent Application Laid-Open (Kokai) Nos. 2002-308223 and 2009-161230. The bag feeding device 13 is combined with a conveyor magazine type bag supplying device 13*a*, and it simultaneously supplies four bags 20 to four sets of grippers 12 in a one-by-one manner.

The printer 14 and the print testing device 15 are publicly known devices.

The bag mouth opening device (only the suction cups 16, 17 are illustrated in FIG. 1) will be described below.

The filling device 18 includes numerous hoppers 21 movable up and down and disposed at equal angular intervals. The hoppers 21 rotate at a constant speed along the circular moving path and at the same time move up and down at predetermined timing. A weighing hopper 22 and a weighing box 23 are installed at equal angular intervals for each hopper 21 and rotate at a constant speed along the circular moving path together with the hoppers 21. At the lower end of each weighing hopper 22, there is installed a shutter (not illustrated) that opens and closes the lower end opening of the weighing hopper 22. Inside the weighing box 23, a weight sensor (for example, a load-cell type sensor), not shown, that measures the weight of the material to be packaged fed to the weighing hopper 22 is provided. One half of the circular portion of the moving path of the hoppers 21 is in overlying alignment with the conveying path (semicircle portion) of the bags 20 held by the grippers 12. With the speed of rotation of the hoppers 21 being coincide with the speed of travel of the grippers 12, the hoppers 21 rotationally travel in synchronism with the transport of the bags 20 directly above the conveying path (semicircle portion) of the bags 20 held by the grippers 12.

In the filling device 18, when the material to be packaged is fed into the weighing hopper 22 from a feeding means, which is not shown, at a predetermined timing, the weight of the material to be packaged is measured by the weight sensor installed in the weighing box 23. Subsequently, the hopper 21 is moved down, its lower end is inserted into a bag 20, the shutter of the weighing hopper 22 is opened, and thus the material to be packaged falls through the hopper 21 into the bag 20 and filled therein. Once the lower end portion of the hopper 21 is inserted into the bag 20, all operations until the bag 20 is filled with the material to be packaged are carried out while the hopper 21 is rotationally traveling in synchronism with the bag 20 being conveyed.

The sealing device 19 is comprised of first sealing devices 19*a*, 19*a* (only the sealing bar of the first sealing device 19*a* on the downstream side is illustrated), which heat-seals the mouth of a filled bag 20 by clamping it with sealing bars, second sealing devices 19*b*, 19*b* (only the two sealing bars are illustrated), and sealed portion cooling devices 19*c*, 19*c* (only the two cooling bars are illustrated), which cool the sealed portion by clamping it with cooling bars. In the same manner as the sealing device described in Japanese Patent Application Laid-Open (Kokai) No. 2001-72004, the sealing device 19 operates such that it follows the grippers 12 for a predetermined distance at the same speed as the grippers, and the sealing bars or cooling bars of the sealing device 19 clamp the mouth of the bag 20 during such time and then release the mouth, and, subsequently, return to the original position. In the shown example, two bags are simultaneously heat-sealed by the first sealing devices 19*a*, 19*a*, whereupon they are simultaneously heat-sealed (for the second time) by the second sealing devices 19*b*, 19*b*, and then simultaneously cooled by the sealed portion cooling devices 19*c*, 19*c*.

The product bag discharging device, which is identical to the opening/closing device (comprised of an opening/closing member and a drive mechanism therefore, etc.) described in Japanese Patent Application Laid-Open (Kokai) Nos. 2002-302227 and 2009-161230, opens the gripping portion of the grippers 12 upon arrival at a predetermined position, drops the product bag (a bag filled with the material) 20A into a chute (not illustrated), and outputs it on an output conveyor (not illustrated). Such an opening/closing device as described above can be provided in the bag feeding device 13; and when the bags 20 are fed to the grippers 12, the gripping portions of the grippers 12 are opened (operates simultaneously on four sets of grippers 12) thereby.

The empty bag discharging device (not illustrated) is the same as the defective bag discharging device described in Japanese Patent Application Laid-Open (Kokai) No. 2009-161230, and it is disposed somewhat upstream side of the product bag discharging device. Being equivalent to the product bag discharging device from a functional standpoint, the empty bag discharging device opens the gripping portion of the grippers 12 to drop the empty bags 20.

Next, the bag mouth opening device of the present invention will be described with reference to FIG. 2 through FIG. 4.

In the continuous transportation type bag filling and packaging apparatus of FIG. 1 in which the bag mouth opening device of the present invention is utilized, numerous bags 20 are vertically suspended with both side or lateral edges thereof held by the grippers 12, and these bags are continuously conveyed along the racetrack-shaped conveying path at a constant speed and at regular intervals. The bag mouth opening device of the present invention opens the mouth of the bag 20 being conveyed along the rectilinear regions of the conveying path.

The differences between the bag mouth opening device of the present invention and the conventional bag mouth opening device of Japanese Patent Application Laid-Open (Kokai) No. 2002-255119 will be described first with reference to FIG. 2.

The bag mouth opening device of the present invention includes a pair of suction cups (suction members) 16, 17. As shown in FIG. 2, the suction cups 16, 17 continuously rotate at a constant speed (speed $V_O$) in mutually opposite directions along the respective elliptical moving paths 24, 25 in a horizontal plane, with their suction surfaces oriented frontally at all times in other words to face the conveying path 1. In the shown example, the moving paths 24, 25 of the suction cups 16, 17 are defined symmetrically on ether side of the conveying path 1, and their major axes 26, 27 are inclined at the same angle relative to the conveying path 1, such that the major axes 26, 27 digress from the conveying path 1 toward the anterior side (which is a forward side in terms of the bag conveying direction), In addition, the suction cups 16, 17 that travel along the moving paths 24, 25, respectively, maintain symmetrical positions on ether side of the bag conveying path 1 at all times. The speed of the bags 20 (not illustrated in FIG. 2) conveyed along the conveying path 1 is $V_0$.

Figure 2:
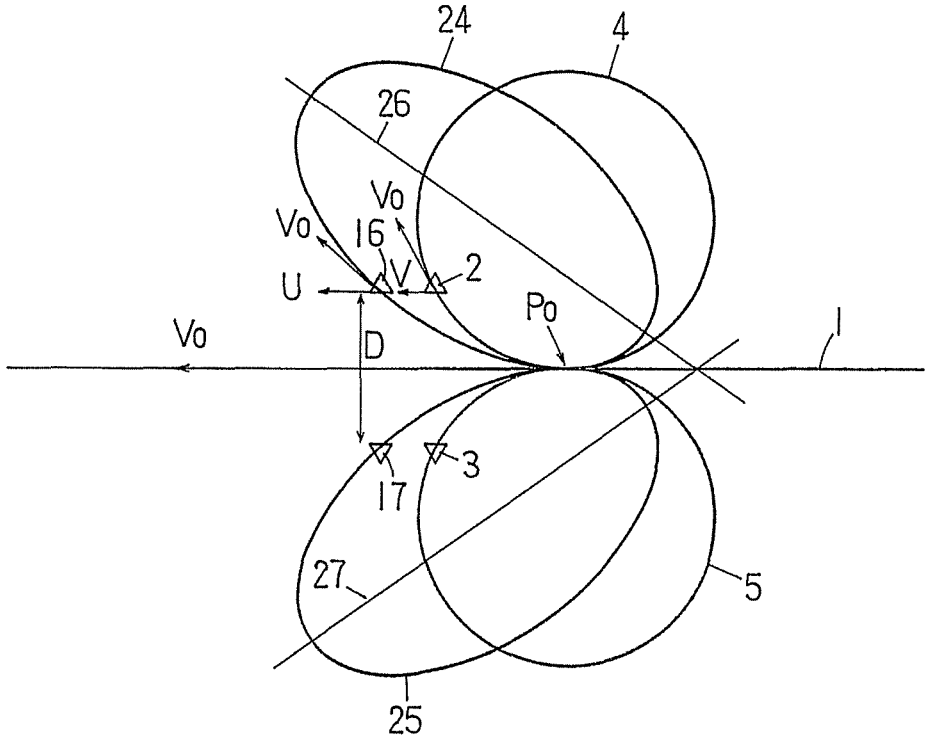
FIG. 2 is a conceptual diagram showing a comparison between the moving paths along which suction members (suction cups) of a bag mouth opening device of the present invention rotate and the moving paths along which the suction cups of the bag mouth opening device of Japanese Patent Application Laid-Open (Kokai) No. 2002-255119 rotate.
Figure 3:
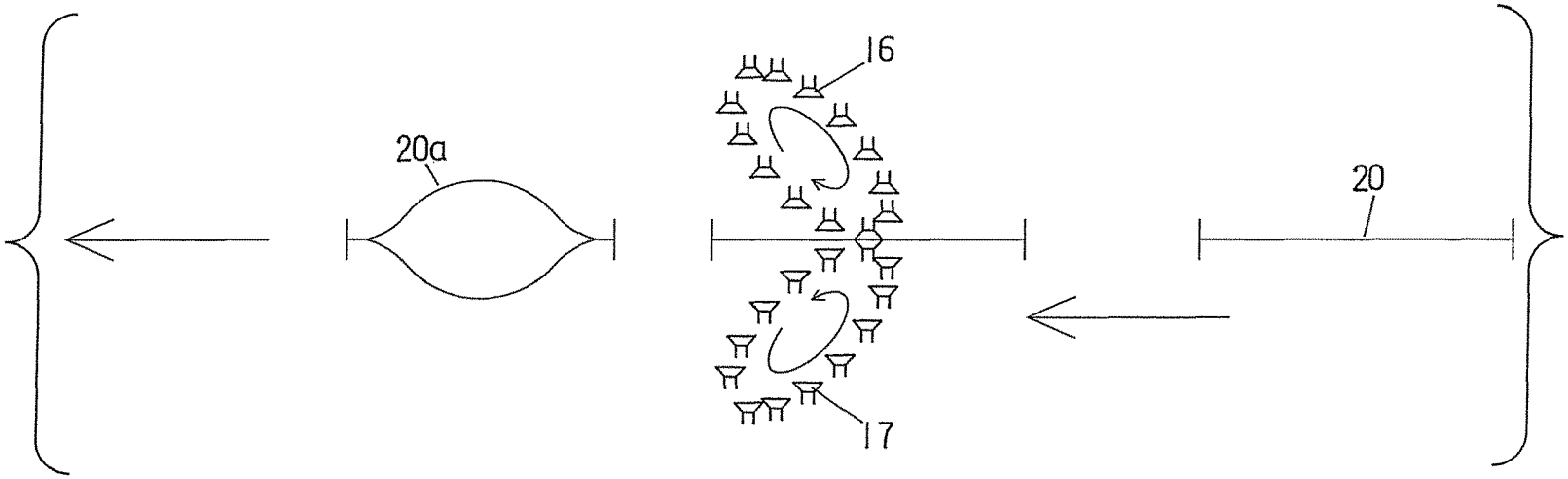
FIG. 3 is a conceptual diagram showing the operation of the suction cups in the bag mouth opening device of the present invention.
Figure 11:
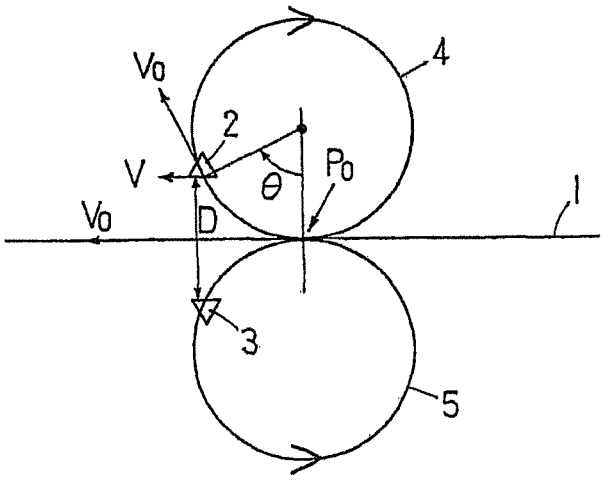
FIG. 11 RELATED ART
FIG. 11 is a conceptual diagram showing the moving paths along which the suction cups of the bag mouth opening device of Japanese Patent Application Laid-Open (Kokai) No. 2002-255119 rotate.

The circular moving paths 4, 5 of FIG. 11 of the conventional suction cups 2, 3 is superimposed on FIG. 2, and they have the same circumferential length as the elliptical moving paths 24, 25 and also are defined symmetrically on ether side of the conveying path 1. The suction cups 2, 3 continuously rotate in a horizontal plane at a constant speed (speed $V_0$) in mutually opposite directions along the circular moving paths 4, 5, respectively, with their suction surfaces oriented frontally at all times to face the bag conveying path 1. The suction cups 2, 3 traveling along the moving paths 4, 5 are provided so as to maintain symmetrical positions on ether side of the conveying path 1 at all times.

As seen from FIG. 2, if the traveling speed of the suction cups 2, 3 in the bag conveying direction (toward left in FIG. 2) is designated as V (which is the component of the conveying speed $V_0$ of the bag in the bag conveying direction) and the traveling speed of the suction cups 16, 17 in the bag conveying direction is designated as U (which is the component of the conveying speed $V_0$ of the bag in the bag conveying direction), then $V=U=V_0$ in position $P_0$ where the suction cups 2, 3 and the suction cups 16, 17 approach the bag conveying path 1 the most (and where the cups suction-hold the bag). On the other hand, once adhered to a bag by suction, the suction cups 2, 3 move away from each other as they travel along the circular moving paths 4, 5, and the suction cups 16, 17 also move away from each other as they travel along the moving paths 24, 25 (for the spacing distance D), and it is clear that in this case U>V (U is greater than V). Then, the more the spacing distance D increases, the greater the difference between the traveling speed U of the suction cups 16, 17 and the traveling speed V of the suction cups 2, 3 becomes (U>>V). In other words, during the bag opening process, the traveling speed U of the suction cups 16, 17 in the bag conveying direction is, in comparison with the traveling speed V of the suction cups 2, 3 in the bag conveying direction, set such that the speed difference with respect to the bag conveying speed $V_0$ is kept smaller ($V_0-U<V_0-V$). As a result, the positional misalignment of the suction cups 16, 17 and the bag in the bag conveying direction is kept smaller. Therefore, even if the width dimensions of the bags are relatively large and it is necessary to make the spacing distance D between the suction cups 16, 17 larger to open the mouth of the bag, the compliance of the suction cups 16, 17 with respect to the bags in the conveying direction is better, and the opening of the mouth of the bag can be carried out in a stable manner.

Next, the mouth opening steps performed by the above-described bag mouth opening device of the present invention will be described in greater detail with reference to FIGS. 3 and 4.

In the continuous transportation type bag filling and packaging apparatus in which the bag mouth opening device of the present invention is utilized, numerous bags 20 are vertically suspended with both side edges or lateral edges thereof being held by the grippers 12, and they are continuously conveyed along the conveying path 1 (see FIG. 2) at a constant speed and at regular intervals (the conveying direction is indicated by the arrow). Pairs of suction members (suction cups 16, 17), which form part of the bag mouth opening device of the present invention, are installed on the opposite sides (or on either side) of the conveying path 1 of the bags 20, respectively.

The suction cups 16, 17 rotate in a horizontal plane in mutually opposite directions along the elliptical moving paths 24, 25 with their suction surfaces frontally oriented so as to face both surfaces of the bag at all times. This motion of the suction cups 16, 17 is translational motion. In the shown example, the elliptical moving paths 24, 25 are defined symmetrically on ether side of the bag conveying path 1 with their major axes 26, 27 (see FIG. 2) inclined at the same angle with respect of the bag conveying path 1, such that the major axes 26, 27 digress from the bag conveying path 1 toward the anterior side (with respect to the bag conveying direction). The suction cups 16, 17 rotate along the moving paths 24, 25 at a constant speed, which is the same speed as the conveying speed $V_0$ of the bags 20, and, at the same time, rotate by maintaining mutually symmetrical positional relationship as viewed from the conveying path 1 of the bags 20. In addition, the time the suction cups 16, 17 take to make a single rotation is set to be equal to the time a bag 20 takes to be conveyed for an inter-bag distance (which is the distance between two bags being conveyed) s (1 pitch), and also the circumferential length of the moving paths 24, 25 of the suction cups 16, 17 is set to be equal to the inter-bag distance s. Furthermore, the timing of conveying the bag 20 and rotating the suction cups 16, 17 is set such that when the suction cups 16, 17 reach the conveying path 1 of the bags 20 (where the suction cups come close the most), they abut the mouth area of the bag 20 substantially in its central portion and adhere thereto by suction.

Figure 4:
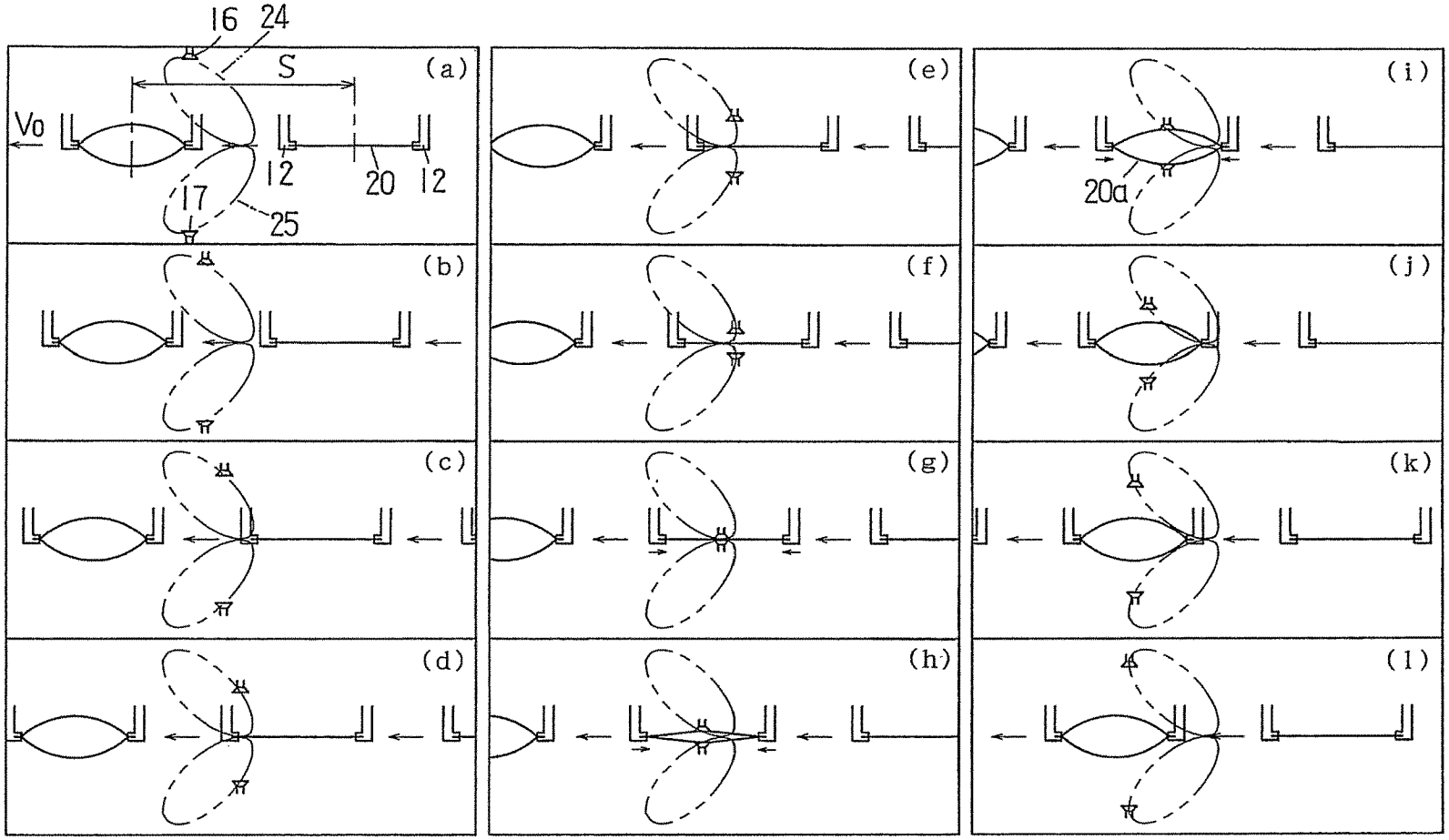
FIG. 4 is a conceptual diagram of a time-sequential description of the bag mouth opening steps performed by the suction cups of the bag mouth opening device of the present invention.

FIG. 4, including illustrations (a)-(l), shows the relationship between one (1) cycle of moving of the suction cups 16, 17 (one (1) rotation) and the conveyance of the bag 20 in the mouth opening procedure. These diagrams are described below in simple terms.

(a)-(d) The suction cups 16, 17 initiate their approach while rotating from the position of maximum separated distance towards the bag conveying path 1, and, on the other hand, an unopened bag 20 is approaching a predetermined position of cup adhesion in a rectilinear manner.

(e)-(f) The suction cups 16, 17 approach the mouth of the bag 20 and vacuum suction is initiated.

(g) The suction cups 16, 17 reach the bag conveying path 1, the suction surfaces of the cups are resiliently pressed against the mouth of the bag 20 from either side, and suction is applied. At such time, the traveling speed of the suction cups 16, 17 in the bag conveying direction is equal to the bag conveying speed $V_0$.

(h)-(i) The suction cups 16, 17, traveling along the elliptical moving paths 24, 25, start moving away from each other while adhering by suction to the bag mouth, resulting in that the mouth of the bag 20 is opened (opened bag 20*a*). The travelling speed of the suction cups 16, 17 in the bag conveying direction is gradually reduced in the process of rotation; however, in comparison with the conventional suction cups 2, 3 rotating along circular moving paths (see FIG. 2), in a case involving the same spacing distance, the difference relative to the bag conveying speed $V_0$ is smaller, which makes it possible to maintain substantially the same speed and ensure superior compliance with the bag 20*a* being conveyed at the constant speed $V_0$. It should be noted that if multiple pairs of suction cups 16, 17 are provided, the circumferential length of the elliptical moving paths 24, 25 is proportionally increased, and as a result of which the speed difference of the bag and the suction cups becomes even smaller.

(j) The vacuum suction of the suction cups 16, 17 is stopped, and the suction surfaces of the suction cups are detached from the mouth of the bag 20*a*.

(k)-(l) The suction cups 16, 17 are moved even farther away from each other, and one (1) cycle of the suction cups ends.

Next, a specific preferred construction of the bag mouth opening device of the present invention will be described with reference to FIG. 5 through FIG. 10. In FIG. 5 through FIG. 10, parts that are substantially equivalent to those of the bag mouth opening device illustrated in FIGS. 1 through 4 are assigned with the same reference numerals.

Figure 5:
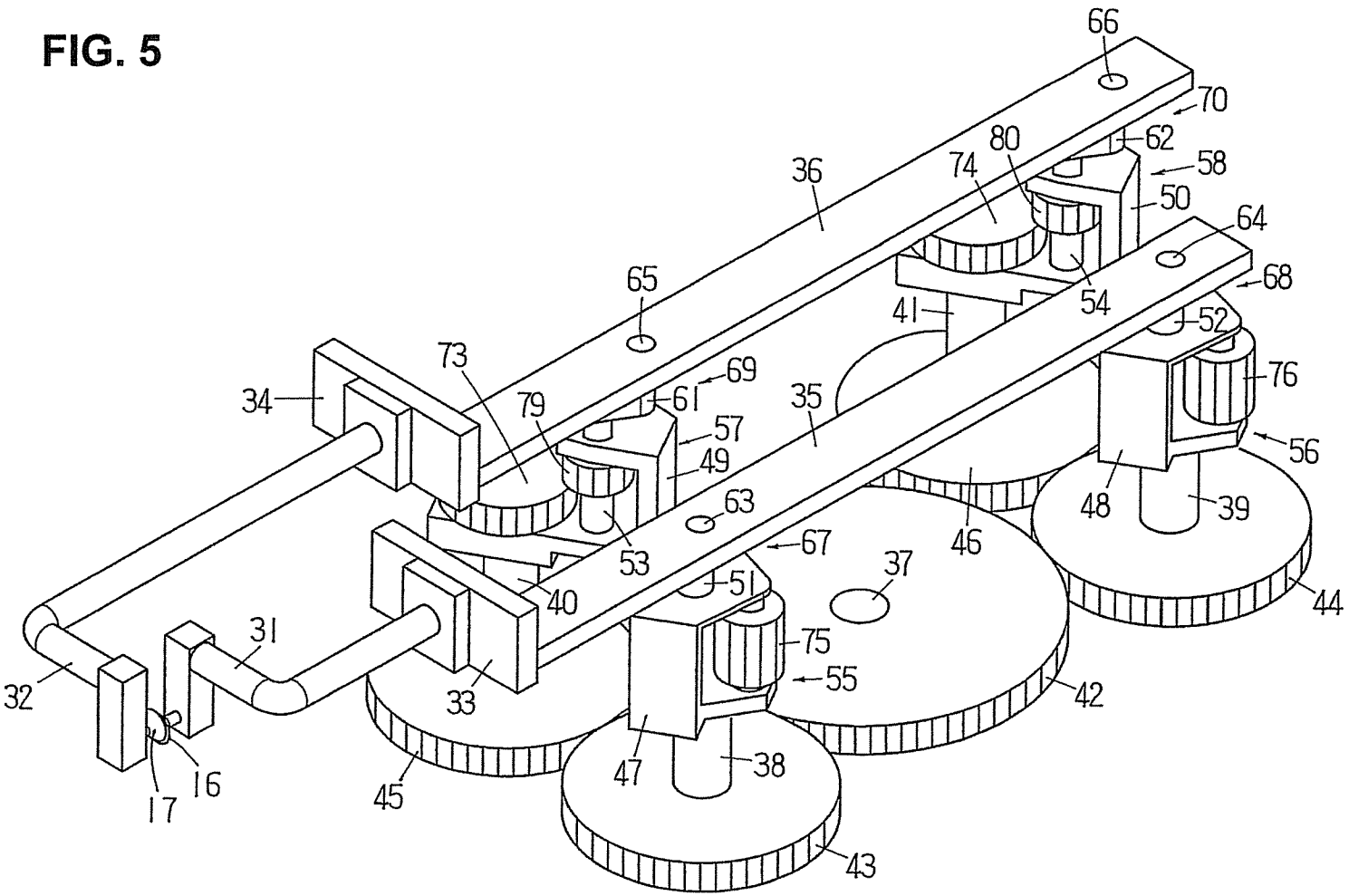
FIG. 5 is a perspective view of the bag mouth opening device of the present invention.
Figure 6:
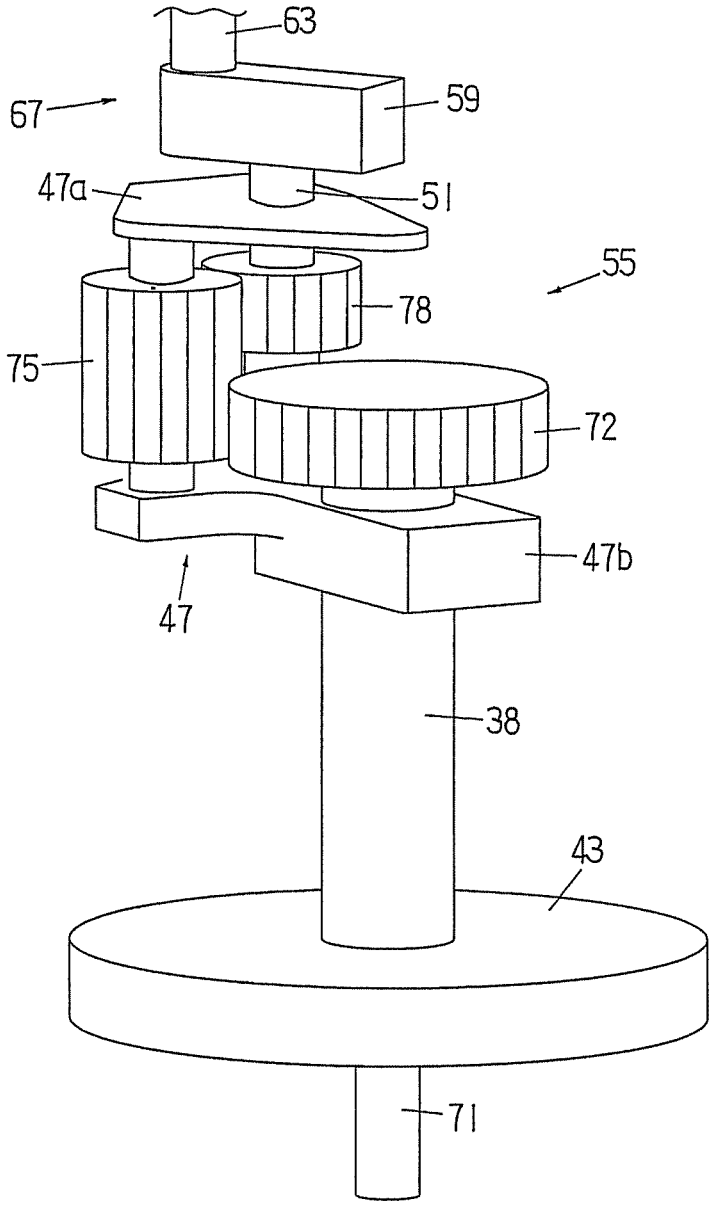
FIG. 6 is a perspective of the main portion thereof, showing one of four mechanisms that make a translational motion of rotation transmission members of the bag mouth opening device of the present invention, four of such mechanism provided therein being substantially the same.
Figure 7:
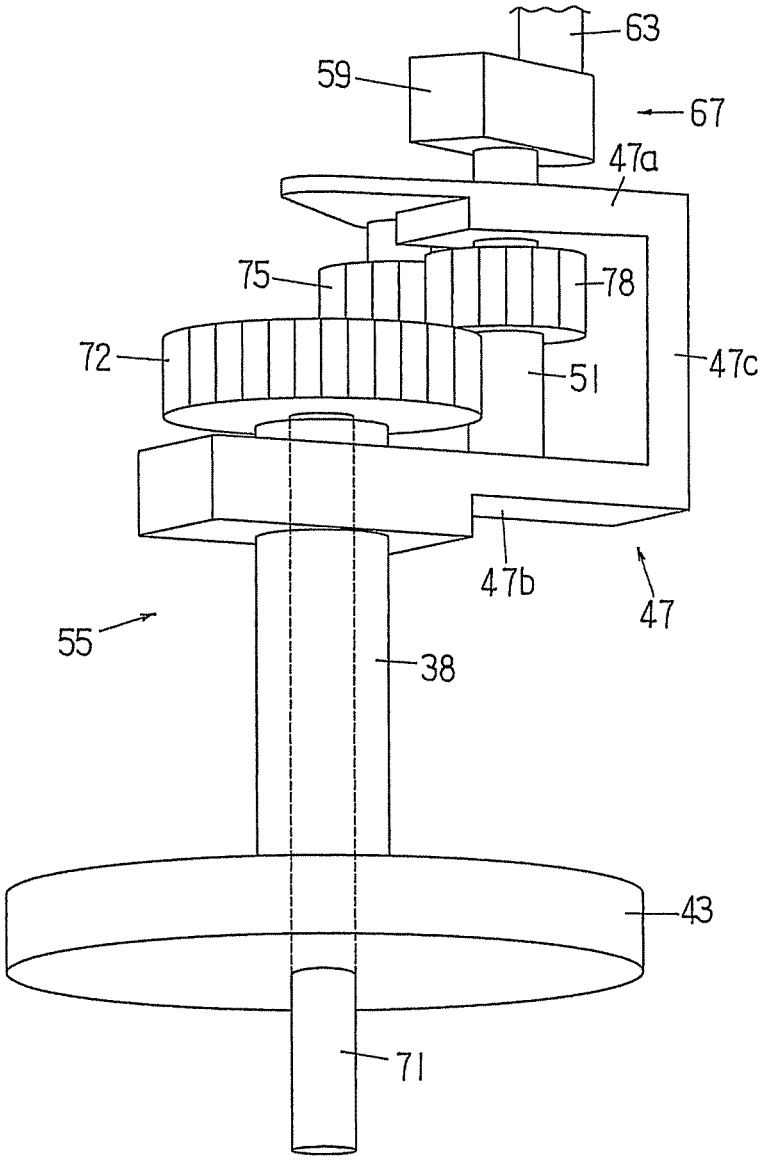
FIG. 7 is also a perspective of the main portion thereof, looking the same from another side.

As shown in FIGS. 5 through 7, the suction cups 16, 17 are secured to the distal ends of mouth opening arms 31, 32, respectively, so that they are provided on plate-shape rotation transmission members 35, 36, respectively, via the mouth opening arms 31, 32 and attachment holders 33, 34. The mouth opening arms 31, 32 are hollow pipes, the suction cups 16, 17 are secured to the distal ends thereof, respectively, vacuum pipes, not shown, are connected to their back ends, respectively, and the vacuum pipes are placed in communication with vacuum sources through filters, change-over valves, and the like. The attachment holders 33, 34 are secured to the front ends of the rotation transmission members 35, 36, respectively, and the back end portions of the mouth opening arms 31, 32 are secured thereto, respectively.

A drive shaft 37 and four first rotating shafts 38 through 41 are vertically provided on a base frame, not shown, in a rotatable manner. A drive gear 42 is secured to the drive shaft 37, and linkage gears 43 through 46 are secured to the first rotating shafts 38 through 41, respectively. The linkage gears 43 through 46 have the same number of teeth. Among these linkage gears 43 through 46, the linkage gears 43, 44 mesh with the drive gear 42; and the linkage gear 45 meshes with the linkage gear 43, and the linkage gear 46 meshes with the linkage gear 44. The drive shaft 37 is coupled to a drive source, not shown, and is rotated at a constant speed; and when the drive gear 42 is rotated by the drive shaft 37, the first rotating shafts 38 through 41 are simultaneously rotated at a constant speed via the linkage gears 43 through 46.

Figure 8:
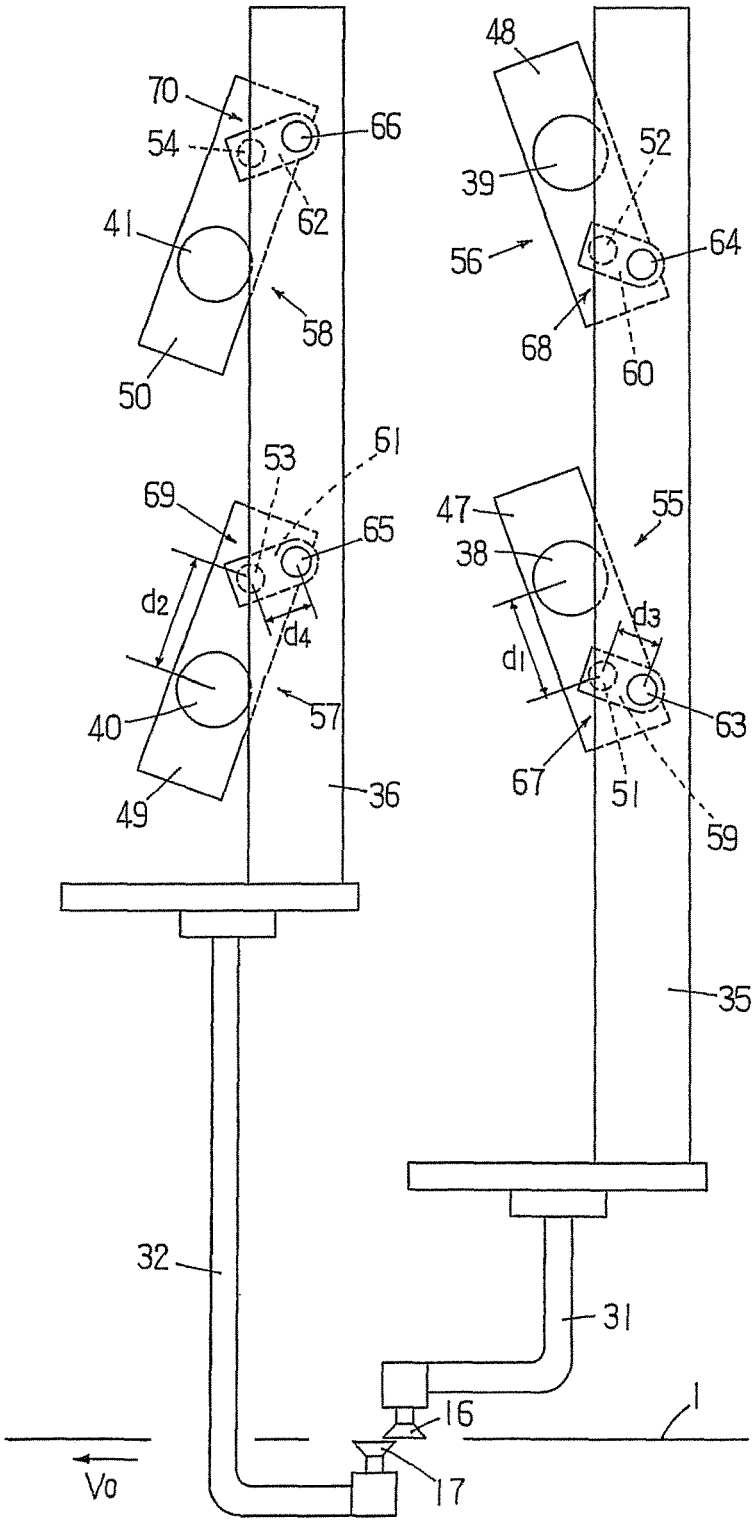
FIG. 8 is a conceptual top view of the construction of the bag mouth opening device of the present invention.

First rotating levers 47 through 50 are secured in the vicinity of the upper ends of the first rotating shafts 38 through 41, respectively. The first rotating levers 47 through 50 are rotated in a horizontal plane at a constant speed when the first rotating shafts 38 through 41 are rotated. As shown in FIGS. 7 and 8, the first rotating lever 47 (the other first rotating levers 48, 49 and 50 have the same construction as the first rotating lever 47 and thus will not be described in detail in the below) is comprised of top and bottom plate-shaped members 47*a*, 47*b* and a connecting member 47*c* that connects the plate-shaped members 47*a* and 47*b*, thus taking a frame-like configuration. Second rotating shafts 51 through 54 are provided vertically on the top and bottom plate-shaped members of the first rotating levers 47 through 50, respectively, in a rotatable fashion. The above-described first rotating shafts 38 through 41 (corresponding to a crank journal), the first rotating levers 47 through 50 (corresponding to a crank arm), and the second rotating shafts 51 through 54 (corresponding to a crankpin) form a type of crank mechanism (or first crank mechanisms 55 through 58, each comprising the first rotating shaft, the first rotating lever, and the second rotating shaft). In the first crank mechanisms 55, 56, the second rotating shafts 51, 52 are provided in locations offset equidistantly and in the same direction relative to the first rotating shafts 38, 39 respectively. Likewise, in the first crank mechanisms 57, 58, the second rotating shafts 53, 54 are provided in locations offset equidistantly and in the same direction relative to the first rotating shafts 40, 41, respectively.

The second rotating shafts 51 through 54 project above the first rotating levers 47 through 50, respectively, and the second rotating levers 59 through 62 (see second rotating lever 60 in FIG. 8) are secured to the upper ends of the second rotating shafts 51 through 54, respectively, and further the support shafts 63 through 66 are provided on the rotating levers 59 through 62, respectively, in a rotatable manner. The above-described second rotating shafts 51 through 54 (corresponding to a crank journal), the second rotating levers 59 through 62 (corresponding to a crank arm), and the support shafts 63 through 66 (corresponding to a crankpin) form a type of crank mechanism (or second crank mechanisms 68 through 70, each comprising the second rotating shaft, the second rotating lever, and the support shaft. In the second crank mechanisms 67, 68, the support shafts 63, 64 are provided in locations offset equidistantly and in the same direction relative to the second rotating shafts 51, 52, respectively. Likewise, in the second crank mechanisms 69, 70, the support shafts 65, 66 are provided in locations offset equidistantly and in the same direction relative to the second rotating shafts 53, 54, respectively.

A rotation transmission member 35 is secured to the upper ends of the support shafts 63, 64, and a rotation transmission member 36 is secured to the upper ends of the support shafts 65, 66.

The first rotating shafts 38 through 41 are hollow inside and have sun gear shafts installed in the hollow interiors, respectively (only sun gear shaft 71 inside the first rotating shaft 38 is shown in FIGS. 6, 7, and the other sun gear shafts, not shown, are provided in the first rotating shafts 39 through 41, respectively, in the same manner as the sun gear shaft 71). The lower ends of the sun gear shafts pass through the centers of the linkage gears 43 through 46, respectively, and are secured to a base frame, not shown, while the upper ends of the respective sun gear shafts project inside the frames of the first rotating levers 47 through 50, respectively, and sun gears are secured to the upper ends of the sun gear shafts, respectively (only the sun gear 72 is shown in FIGS. 6 and 7 for the first rotating lever 47, the sun gear for the first rotating lever 48 is not shown, and the sun gears 73, 74 for the first rotating lever 49, 50 are shown in FIG. 5). The centers of the sun gears coincide with the axial lines of the first rotating shafts 38 through 41, respectively.

Planetary gears meshing with sun gears are journaled inside the frames of the first rotating levers 47 through 50, respectively, in a rotatable manner (only planetary gears 75, 76 are shown in FIGS. 5 through 7). Furthermore, driven gears are secured to the second rotating shafts 51 through 54, respectively (only driven gears 78 through 80 are shown in FIGS. 5 through 7), and these driven gears mesh with the planetary gears, respectively.

The above-described sun gears, planetary gears, and driven gears constitute drive mechanisms that rotate the second rotating shafts 51 through 54, respectively (although not indicative for all, as can be seen from the above description, four sun gears, planetary gears, and driven gears are provided in the shown example, with each for each one of the drive mechanisms that rotate the second rotating shafts). Also, in the shown example, the gear ratio of the sun gears, planetary gears, and driven gears is set to 2:1:1. However, since the planetary gears are substantially idle gears, the gear ratio of the sun gears and planetary gears does not have to be 2:1.

In the above-described bag mouth opening device, when the drive gear 42 is rotated, it rotates the first rotating shafts 38 through 41 via the linkage gears 43 through 46, and the first rotating levers 47 through 50 are also rotated. As a result, in the first crank mechanisms 55 through 58, the second rotating shafts 51 through 54 are rotated around the first rotating shafts 38 through 41, respectively. On the other hand, when the first rotating levers 47 through 50 rotate, the planetary gears and the driven gears within the first rotating levers 47 through 50 turn while rotating (revolving) around the sun gears, respectively, and the second rotating shafts 51 through 54 turn while rotating (revolving) around the first rotating shafts 38 through 41, respectively, and the second rotating levers 59 through 62 are rotated, respectively, as well. As a result, in the second crank mechanisms 67 through 70, the support shafts 63 through 66 rotate around the second rotating shafts 51 through 54, respectively.

In the first crank mechanisms 55 through 58, the second rotating shafts 51 through 54 make two rotations (turns) on the first rotating levers 47 through 50, respectively, while the first rotating shafts 38 through 41 (and the respective first rotating levers 47 through 50) make a single rotation. Therefore, the second rotating levers 59 through 62, which rotate together with the second rotating shafts 51 through 54, respectively, make two rotations relative to the first rotating levers 47 through 50 while the first rotating levers 47 through 50 make a single rotation. In addition, since the direction of rotation of the second rotating levers 59 through 62 is opposite to the direction of rotation of the first rotating levers 47 through 50, respectively, each of the second rotating levers 59 through 62, in an absolute sense, make a single counter-rotation relative to the first rotating levers 47 through 50, respectively, while the first rotating levers 47 through 50 make a single rotation.

Figure 10:
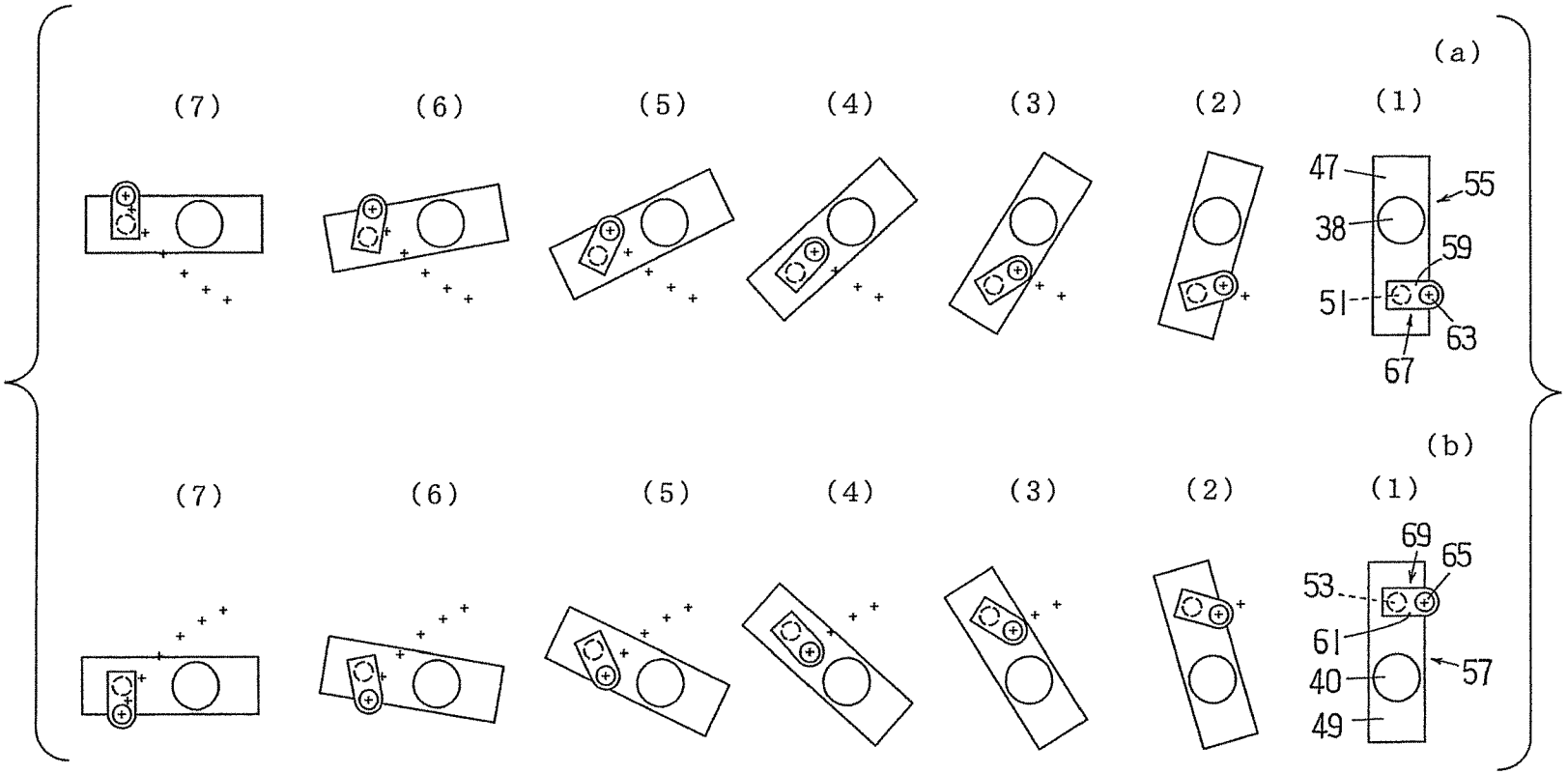
FIG. 10 is a conceptual top view showing a time-sequential description of the operation of a crank mechanism that rotates the suction cups of the bag mouth opening device of the present invention.

FIG. 10 shows the positional relationship between the first rotating levers 47 through 50 (only the first rotating levers 47, 49 are illustrated) and the second rotating levers 59 through 62 (only the second rotating levers 59, 61 are illustrated) in a time-sequential manner, from right to left or (1) to (7). While the first rotating lever 47 rotates 90 degrees to the right about the first rotating shaft 38 as seen from (a)(1) to (a)(7), the second rotating lever 59 rotates 90 degrees to the left about the second rotating shaft 51 in an absolute sense, and at the same time it rotates 180 degrees to the left with respect to the first rotating lever 47 (The rotational relationship between the first rotating lever 48 and the second rotating lever 60 is the same as that of the first rotating lever 47 and the second rotating lever 59). On the other hand, while the first rotating lever 49 rotates 90 degrees to the left about the first rotating shaft 40, the second rotating lever 61 rotates 90 degrees to the right about the second rotating shaft 53 in an absolute sense, and at the same time it rotates 180 degrees to the right with respect to the first rotating lever 49 (The rotational relationship between the first rotating lever 50 and the second rotating lever 62 is the same as that of the first rotating lever 49 and the second rotating lever 61).

Figure 9:
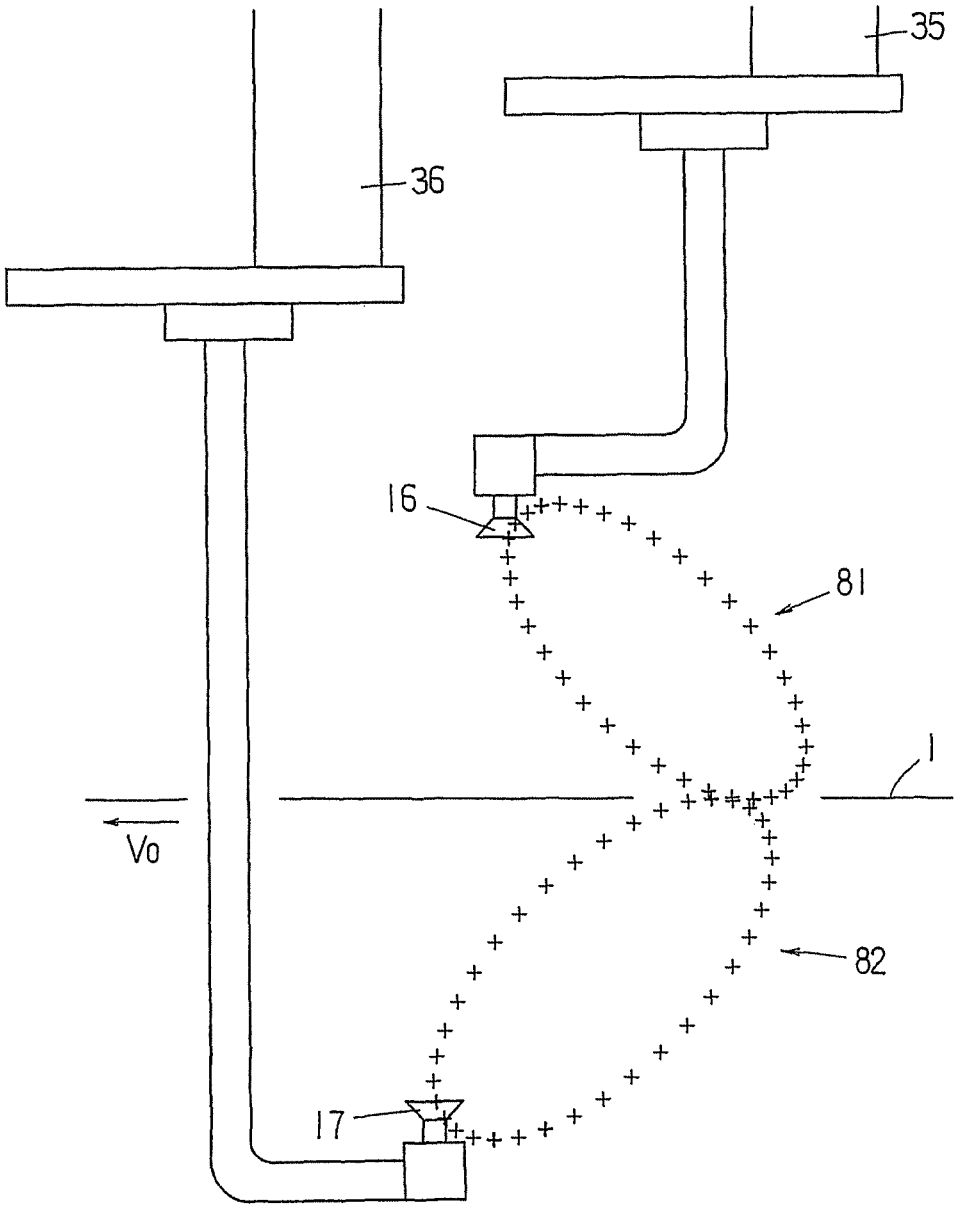
FIG. 9 is a conceptual top view showing moving paths along which the suction cups of the bag mouth opening device of the present invention rotate.

Next, the moving paths along which the suction cups 16, 17 are rotated in the bag mouth opening device of FIGS. 5 through 7 will be described below with reference to FIGS. 8 through 10.

As shown in FIG. 8, in this bag mouth opening device, the first rotating shafts 38, 39 for the cup 16 are provided in a line perpendicular to the bag conveying path 1, and, in a similar manner, the first rotating shafts 40, 41 for the cup 17 are provided in a line perpendicular to the bag conveying path 1.

In the first crank mechanisms 55, 56 for the cup 16, the second rotating shafts 51, 52 are installed in positions offset equidistantly and in the same direction relative to the first rotating shafts 38, 39, respectively; and in the second crank mechanisms 67, 68 for the cup 16, the support shafts 63, 64 are respectively installed in positions offset equidistantly and the support shafts 63, 64 are installed in positions offset equidistantly and in the same direction relative to the second rotating shafts 51, 52, respectively. On the other hand, in the first crank mechanisms 57, 58 for the cup 17, the second rotating shafts 53, 54 are installed in positions offset equidistantly and in the same direction relative to the first rotating shafts 40, 41, respectively; and in the second crank mechanisms 69, 70 for the cup 17, the support shafts 65, 66 are installed in positions offset equidistantly and in the same direction relative to the second rotating shafts 53, 54, respectively.

In addition, the distance $d_1$ between the first rotating shaft 38 and the second rotating shaft 51 for the cup 16 (the distance between the first rotating shaft 39 and the second rotating shaft 52 for the cup 16 has the same length $d_1$) is set to be slightly shorter than the distance $d_2$ that is between the first rotating shaft 40 and the second rotating shaft 53 for the cup 17 (the distance between the first rotating shaft 41 and the second rotating shaft 54 for the cup 17 has the same length $d_2$). Further, the distance $d_3$ between the second rotating shaft 51 and the support shaft 63 for the cup 16 (the distance between the second rotating shaft 52 and the support shaft 64 for the cup 16 has the same length $d_3$) is set to be slightly shorter than the distance $d_4$ between the second rotating shaft 53 and the support shaft 65 for the cup 17 (the distance between the second rotating shaft 54 and the support shaft 66 for the cup 17 has the same length $d_4$).

The direction of rotation of the first rotating shafts 38, 39 for the cup 16 and the direction of rotation of the first rotating shafts 40, 41 for the cup 17 are mutually opposite, and the direction of rotation of the second rotating shafts 51, 52 for the cup 16 and the direction of rotation of the second rotating shafts 53, 54 for the cup 17 are also mutually opposite.

The first rotating shafts 38, 39 and support shafts 63, 64, all for the cup 16, can be considered as four joints of a parallel linkage mechanism, and the rotation transmission member 35 that corresponds to a linkage in such a parallel linkage mechanism rotates in a horizontal plane while being oriented perpendicularly to the bag conveying path 1 at all times. Likewise, the first rotating shafts 40, 41 and support shafts 65, 66, all for the cup 17, can be considered as four joints of another parallel linkage mechanism, and the rotation transmission member 36 that corresponds to a linkage in such a parallel linkage mechanism rotates in a horizontal plane while being oriented perpendicularly to the bag conveying path 1 at all times. The direction of rotation of the rotation transmission member 35 for the cup 16 and the direction of rotation of the rotation transmission member 36 for the cup 17 are mutually opposite. This rotation of the rotation transmission members 35, 36 is a translational motion, and thus, as the rotation transmission members 35, 36 rotate, the suction cups 16, 17 rotate in mutually opposite directions, with their suction surfaces oriented frontally at all times to face the surface of the bag.

As shown in (a)-(1) of FIG. 10, the second rotating shaft 51 and the first rotating shaft 38 of the first crank mechanism 55 for the cup 16 are arranged along a line perpendicular to the conveying path 1 (see FIG. 8), and, at the same time, when the second rotating shaft 51 comes to closest to the conveying path 1, the support shaft 63 and the second rotating shaft 51 of the second crank mechanism 67 for the cup 16 are on a line parallel to the conveying path 1, and, in addition, the support shaft 63 is positioned on the posterior side of the second rotating shaft 51 (posterior side relative to the bag conveying direction). The same positional relationship applies to the first crank mechanism 56 and the second crank mechanism 68 both for the cup 16.

On the other hand, as far as the first crank mechanisms 57, 58 and the second crank mechanism 69, 70, which are all for the cup 17, are concerned, the directions of rotation of the first rotating shafts 40, 41 and the second rotating shafts 53, 54 are opposite to those of the first rotating shafts 38, 39 and the second rotating shafts 51, 52 all for the cup 16. As shown in (b)-(1) of FIG. 10, the second rotating shaft 53 and the first rotating shaft 40 of the first crank mechanism 57 for the cup 17 are on a line perpendicular to the conveying path 1, and, at the same time, when the second rotating shaft 53 comes farthest from the conveying path 1, the support shaft 65 and the second rotating shaft 53 of the second crank mechanism 69 for the cup 17 are on a line parallel to the conveying path 1, and, in addition, the support shaft 65 is positioned on the posterior side of the second rotating shaft 53. The same positional relationship applies to the first crank mechanism 58 and the second crank mechanism 70 both for the cup 17.

As shown in (a)-(1) through (7) and (b)-(1) through (7) of FIG. 10, in the first crank mechanisms 55, 57 for the cups 16, 17, respectively, the first rotating shafts 38, 40 rotate, and the second rotating shafts 51, 53 rotate about the first rotating shafts 38, 40, respectively, (or they revolve around first rotating shafts 38, 40, respectively) forward relative to the bag conveying direction; and, in the second crank mechanisms 67, 69 for the cups 16, 17, respectively, the second rotating shafts 51, 53 turn in a direction opposite to that of the first rotating shafts 38, 40, respectively, and the support shafts 63, 65 rotate about the second rotating shafts 51, 53, respectively, forward relative to the bag conveying direction. The rotational trajectory of the support shaft 63 for the cup 16 is the one obtained by combining the motions of the first crank mechanism 55 and the second crank mechanism 67, while the rotational trajectory of the support shaft 65 for the cup 17 is the one obtained by combining the motions of the first crank mechanism 57 and the second crank mechanism 69. The symbols "+" shown in FIG. 10 indicate, at regular time intervals, the rotational trajectories of the support shafts 63 (in (a)), 65 (in (b)) obtained when the first rotating shafts 38, 40 for the cups 16 and 17 make the quarter-turn. The same as described above occurs in the first crank mechanism 56, 58 and in the second crank mechanisms 68, 70.

When the first rotating shafts 38 through 41 make their single rotations, the rotational trajectories of the support shafts 63 through 66 draw a substantially elliptical path. As a result, the rotation transmission member 35 coupled to the support shafts 63, 64 for the cup 16 and the rotation transmission member 36 coupled to the support shafts 65, 66 for the cup 17 make translational motions along the substantially elliptical moving paths. Therefore, as shown in FIG. 9, the suction cup 16 continuously rotates along the substantially elliptical moving path 81 (which is the same as the trajectory of motion and shape of the support shafts 63 and 64 viewed from above), and the suction cup 17 continuously rotates along the substantially elliptical moving path 82 (which is the same as the trajectory of motion and shape of the support shafts 65 and 66 viewed from above) while maintaining the substantially mutually symmetrical positions relative to the suction cup 16. The symbols "+" in FIG. 9 that draw the moving paths 81, 82 of substantially elliptical shape indicate, at regular time intervals, the rotational trajectories of the suction cups 16, 17.

The traveling speed of the suction cups 16, 17 is set to closely match the conveying speed $V_0$ of the bag at the moment when the suction cups 16, 17 are closest to the bag conveying path 1. In addition, as can be seen from the "+" symbols used to draw the moving paths 81, 82, in the bag mouth opening device of the present invention, the traveling speed of the suction cups 16, 17 along the moving paths 81, 82 becomes higher in the regions where the curvature of the moving paths 81, 82 is smaller and becomes lower in the regions where the curvature is larger. In other words, during the bag opening process, the traveling speed of the suction cups 16, 17 along the moving paths 81, 82 becomes higher as the moving paths 81, 82 digress from the conveying path 1. As a result, when the suction cups 16, 17 travel along the moving paths 81, 82 after adhering to both sides of the bag 20 by suction, the traveling speed of the suction cups 16, 17 in the conveying direction of the bag 20 is maintained at substantially the same speed as the traveling speed of the bag 20, and their compliance with the bags 20 being conveyed is superior in comparison with a case in which the suction cups 16, 17 travel along the moving paths 24, 25 at a constant speed (see FIG. 2).

The major axes of the moving paths 81, 82 are inclined at 45 degrees with respect to the bag conveying path 1. This is due to the fact that the angle made by the first crank mechanisms 55 through 58 and the respective second crank mechanisms 67 through 70 is set such that when the second rotating shafts 51 through 54 and the first rotating shafts 38 through 41 of the first crank mechanisms 55 through 58 are arranged along the line perpendicular to the bag conveying path 1, the support shafts 63 through 66 and the second rotating shafts 51 through 54 of the second crank mechanisms 67 through 70 are on the lines parallel to the conveying path 1, respectively. The angles of inclination in the major axes of the moving paths 81, 82 can be changed by changing the angles of the first and second crank mechanisms.

In the bag mouth opening device of the present invention, the distance $d_1$ between the first and second rotating shafts 38 and 51 and between the first and second rotating shafts 39 and 52 (all for the cup 16) is set to be slightly shorter than the distance $d_2$ between the first and second rotating shafts 40 and 53 and between the first and second rotating shafts 41 and 54 (all for the cup 17); and further the distance $d_3$ between the second rotating shaft 51 and the support shaft 63 and between the second rotating shaft 52 and the support shaft 64 (all for the cup 16) is set to be slightly shorter than the distance $d_4$ between the second rotating shaft 53 and the support shaft 65 and between the second rotating shaft 54 and the support shaft 66 (all for the cup 17). Because of this arrangement, the circumferential length of the moving path 81 is slightly shorter than that of the moving path 82, and therefore the traveling speed of the suction cup 16 traveling along the moving path 81 is slightly lower than that of the suction cup 17 traveling along the moving path 82. Due to this fact that the traveling speeds of the suction cups 16, 17 upon their adhesion to the film sheets of both sides of the bag 20 differs slightly, a relative shift, though very minimum, occurs in the bag conveying direction between the two film sheets upon adhesion; and as a result, the close adhesion between the two film sheets is weakened, and the bag 20 can be opened smoothly.

In the bag mouth opening device of the present invention, the moving path 81 of the suction cup 16 is defined somewhat more towards the posterior side (toward right in FIG. 9) in the conveying direction of the bags 20 in comparison with the moving path 82 of the suction cup 17. Therefore, there is a fore-and-aft shift in the bag conveying direction between the positions in which the moving paths 81, 82 are closest to the bag conveying path 1; and when the suction cups 16, 17 come closest to the bag conveying path 1 and adhere by suction to both sides of the bag 20, there is a slight fore-and-aft shift between the positions of adhesion in the conveying direction of the bag 20. As a result, when the suction cups 16, 17 are moved away from each other, air can easily penetrate between the two film sheets of both sides of the bag 20, and the bag 20 can be opened smoothly for this reason as well.

It should be noted that while a planetary gear mechanism (a sun gear, planetary gears, and driven gears) is employed in the above-described bag mouth opening device of the present invention as a drive mechanism for the second rotating shafts 51 through 54, it is also possible to provide other drive sources such as servo motors instead of the planetary gear mechanism on the first rotating levers 47 through 50 in order to turn the second rotating shafts 51 through 54, respectively. In such a structure, the traveling speed of the suctions cups 16, 17 along the respective moving paths 81, 82 can be adjusted more freely by adjusting the speed of rotation of the second rotating shafts 51 through 54, and, for example, the speed of travel of the suction cups 16, 17 in the conveying direction of the bags 20 during the bag mouth opening process can be set at the same speed as the conveying speed of the bags 20.

The invention claimed is:

1. A bag mouth opening device for continuously conveyed bags, comprising:

a pair of opposed suction members configured to be adhered to both sides of mouths of bags continuously conveyed along a bag conveying path at a constant speed and regular intervals and moved away from each other to open the mouths of the bags;

rotation transmission members on which the pair of suction members are directly provided, wherein:

the rotation transmission members make a translational motion to continuously rotate the pair of suction members in mutually opposite directions along complete circumferential lengths of moving paths of substantially elliptical shape, the moving paths being in planes substantially parallel to the bag conveying path and substantially perpendicular to surfaces of the bags, and the moving paths having major axes inclined at substantially equal angles relative to the bag conveying path that digress from the bag conveying path on an anterior side, and the rotation transmission members orient suction surfaces of the pair of suction members frontally at all times; and a drive mechanism that drives the rotation transmission members to make the translational motion to rotate the pair of suction members in a single rotation in a time that is an integer multiple of a time that a bag takes to be conveyed for an inter-bag distance.

2. The bag mouth opening device for continuously conveyed bags according to claim 1, wherein the drive mechanism is comprised of:

two first rotating shafts rotated in a same direction at a constant speed;

a first rotating lever secured to each one of the first rotating shafts;

a second rotating shaft which is journaled on each one of the first rotating levers in a rotatable manner in locations offset equidistantly and in a same direction relative to each one of the first rotating shafts and turns at a constant speed in a direction opposite to a direction of rotation of the first rotating shafts;

a second rotating lever secured to each one of the second rotating shafts; and a support shaft provided on each one of the second rotating levers in locations offset equidistantly and in a same direction relative to the second rotating shafts, and wherein the rotation transmission members are coupled to the support shafts, respectively, to make the translational motion.

3. The bag mouth opening device for continuously conveyed bags according to claim 2, wherein a drive mechanism that causes each of the second rotating shafts to turn in a same direction at a constant speed is comprised of:

a fixed sun gear whose center is on an axial line of the first rotating shaft;

a planetary gear rotatably journaled on the first rotating lever and meshing with the fixed sun gear; and a driven gear secured to the second rotating shaft and meshing with the planetary gear, and a gear ratio of the fixed sun gear and the driven gear is 2:1.

4. The bag mouth opening device for continuously conveyed bags according to any of claims 1, 2 and 3, wherein the circumferential lengths of the moving paths of the pair of suction members are different.

5. The bag mouth opening device for continuously conveyed bags according to any of claims 1, 2 and 3, wherein a fore-and-aft shift in positions of adhesion of the pair of suction members in a bag conveying direction is provided.

6. The bag mouth opening device for continuously conveyed bags according to claim 4, wherein a fore-and-aft shift in positions of adhesion of the pair of suction members in a bag conveying direction is provided.

7. The bag mouth opening device for continuously conveyed bags according to claim 1, wherein the drive mechanism comprises:

two first rotating shafts rotated in a same direction at a constant speed;

two first rotating levers, each first rotating lever secured to a corresponding first rotating shaft of the two first rotating shafts;

two second rotating shafts, each second rotating shaft is journaled on a corresponding first rotating lever of the two first rotating levers in a rotatable manner in locations offset equidistantly and in a same direction relative to a corresponding first rotating shaft of the two first rotating shafts and turns at a constant speed in a direction opposite to a direction of rotation of the corresponding first rotating shaft;

two second rotating levers, each second rotating lever secured to a corresponding second rotating shaft of the two second rotating shafts; and two support shafts, each support shaft provided on a corresponding second rotating lever of the two second rotating levers in locations offset equidistantly and in a same direction relative to a corresponding second rotating shaft of the two second rotating shafts, wherein the rotation transmission members are coupled to a corresponding support shaft of the two support shafts to make the translational motion.

* * * * *